US008112959B2

(12) United States Patent
Michiels

(10) Patent No.: US 8,112,959 B2
(45) Date of Patent: Feb. 14, 2012

(54) DEVICE CONNECTING CONCRETE SLABS AT AN EXPANSION JOINT

(75) Inventor: Pierre Michiels, Tervuren (BE)

(73) Assignee: Plakabeton S.A., Ternat (BE)

( * ) Notice: Subject to any disclaimer, the term of this patent is extended or adjusted under 35 U.S.C. 154(b) by 95 days.

(21) Appl. No.: 11/859,391

(22) Filed: Sep. 21, 2007

(65) Prior Publication Data

US 2008/0222984 A1 Sep. 18, 2008

Related U.S. Application Data

(60) Provisional application No. 60/846,665, filed on Sep. 22, 2006, provisional application No. 60/855,927, filed on Oct. 31, 2006.

(51) Int. Cl.
*E04B 1/68* (2006.01)
*E04F 15/14* (2006.01)
*E01C 11/14* (2006.01)

(52) U.S. Cl. ..... 52/396.05; 404/60

(58) Field of Classification Search ..... 52/396.02, 52/396.05; 404/59, 66, 60

See application file for complete search history.

(56) References Cited

U.S. PATENT DOCUMENTS

| | | | | |
|---|---|---|---|---|
| 2,138,817 | A | 12/1938 | Jacobson | |
| 2,176,574 | A | 10/1939 | Jacobson | |
| 2,256,930 | A * | 9/1941 | Willard | 404/59 |
| 2,302,773 | A | 11/1942 | Jacobson | |
| 2,349,983 | A | 5/1944 | Musall | |
| 2004/0107661 | A1 | 6/2004 | Michiels | |

FOREIGN PATENT DOCUMENTS

| | | | |
|---|---|---|---|
| BE | 1 015 453 | A3 | 4/2005 |
| DE | 34 24 362 | A1 | 1/1986 |
| WO | WO 01/34912 | A1 | 5/2001 |

* cited by examiner

*Primary Examiner* — Michael Safavi
(74) *Attorney, Agent, or Firm* — Merchant & Gould P.C.

(57) ABSTRACT

A device equips an expansion joint between slabs in building constructions, in particular concrete slabs. According to a first embodiment, the device is made up of two profiles (3,4) that fit together in such a way that the elements passing through the joint between the slabs are discontinuous and have a bracket shape anchored by plate dowel anchors. According to a second embodiment, the device has a single profile, the lower part of which is bent alternately in one slab part and the other on each side of the joint.

4 Claims, 5 Drawing Sheets

DEVICE CONNECTING CONCRETE SLABS AT AN EXPANSION JOINT

FIELD OF THE INVENTION

The present invention is related to the construction field, in particular to the production of concrete slabs for example used as industrial floors, and to the devices that equip the joints between parts of slabs.

In this description, the word "joint" is used exclusively to denote the zone or space between two adjacent slabs while, in the area of construction, this term is generally used to refer to the device itself which occupies such a zone.

STATE OF THE ART

The problems associated with joints between slabs are well known in the construction field. The device that equips them must be able to fulfil one or advantageously several functions:

- absorb dimensional variations due to shrinkage and temperature differences;
- support heavy loads, leaving the slabs level;
- protect the slab edges in the upper part;
- reduce the lift of the slab edges following differential shrinkage in the thickness.

Originally, joints were equipped with sliding dowels, but the difficulty of placing the dowels perfectly parallel is such that the method is currently avoided.

In general, joints are equipped with a continuously folded, double metal profile at mid-height of the slab, possibly forming an assembly of the mortise-and-tenon type or leaving space for a continuous flat metal element. This type of profile has the great drawback of reducing the strength of the slab near the joint, since it cuts the joint continuously at mid-height: only one half of the slab withstands heavy loads. In addition, to produce angled joint junctions is particularly tricky and requires a great deal of labour.

Other profiles have therefore been developed. These are devices composed of two juxtaposed profiles equipped at regular spacings with flat dowels passing through the joint in one and the same horizontal plane, one end of which is anchored in the slab on one side of the joint while the other end has the possibility of sliding in a sheath embedded in the slab on the other side of the joint. However, this device, although already more effective, does not provide a solution to the lift of the slab edges since it may be likened to an articulation.

Document US2004/0107661 presents another device, composed of two metal plates folded at right angles, a horizontal part of which is placed beneath the slab and a vertical part is flush with the surface of the slab. This solution is advantageous from a strength standpoint, but it is very expensive to manufacture because of the amount of steel used, and it has several installation difficulties since the form of the foundation must be set perfectly level before the device is put into place.

AIMS OF THE INVENTION

The aim of the present invention is to produce a device for equipping joints in slabs, which is inexpensive to produce, easy to implement and fulfils the functions expected of it, without having the disadvantages of the current prior art.

SUMMARY OF THE INVENTION

The invention is related to devices as described in the appended claims.

According to a first embodiment, the invention is related to a device composed of two profiles which fit together, one in the other, by discontinuous bracket-shaped projections in order to ensure continuity in a slab in line with a joint while still permitting movements in the horizontal plane and protecting the slab edges, but opposing any lift and differential transverse movements.

According to a second embodiment, the invention is related to a device consisting of a profile, one part of which is bent up alternately in one direction and then in the other, to which any second profile is joined, being temporarily fastened to the first. Certain bent-up parts pass through the joint and are provided with a sheath in order to allow free movement in all directions in the plane of the slab. The two profiles are each anchored in a slab part separated by the joint.

DETAILED DESCRIPTION OF THE INVENTION

FIGS. 1 to 4 show a device according to a first embodiment of the invention. This first embodiment is characterized by the design of the device in the sense that it is made up of two profiles that fit together in such a way that the elements passing through the joint between the slabs are discontinuous and have in fact a bracket shape anchored by dowel anchors. This configuration has the particular feature of being likened to an embodiment.

Figure 1:
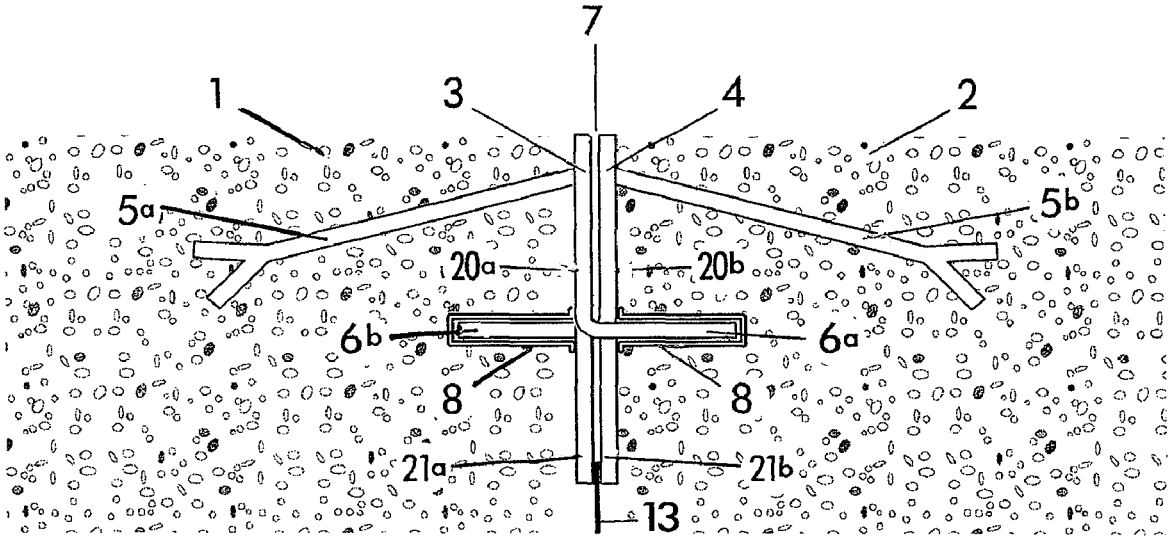
FIG. 1 represents a side view of a device according to a first embodiment of the invention.

FIG. 1 gives an example of the device according to the first embodiment. Placed in the joint separating two slabs 1 and 2 is a device composed of two profiles 3 and 4, preferably made of metal, each placed vertically and anchored in the slab on one side of the joint by means of anchoring dowels 5*a*, 5*b*. Certain parts 6*a*, 6*b* of the profiles 3 and 4 have been bent up at discrete places in order to pass through the joint 7 and the other profile in order to extend into the other slab. The device is such that the bent-up projections 6*a*,6*b* are alternately in one slab then in the other slab on each side of the joint 7. A sheath 8 placed over this bent-up projection allows the latter to move in all directions in the plane of the slab, but independently of the latter. The sheath 8 is necessary for a good operation of the device, but it is not necessarily a part of the device as such. It can be attached in a temporary way to the profiles, or simply placed over the projections before the device is installed.

The anchoring dowels 5*a*,5*b* may be plate dowel anchors. The dowels are fixed to an upstanding portion of each profile and extend outwards from the profile without crossing the joint. This way, the dowels are arranged for anchoring the first and second profile in the slab on the respective side of the joint.

Figure 2:
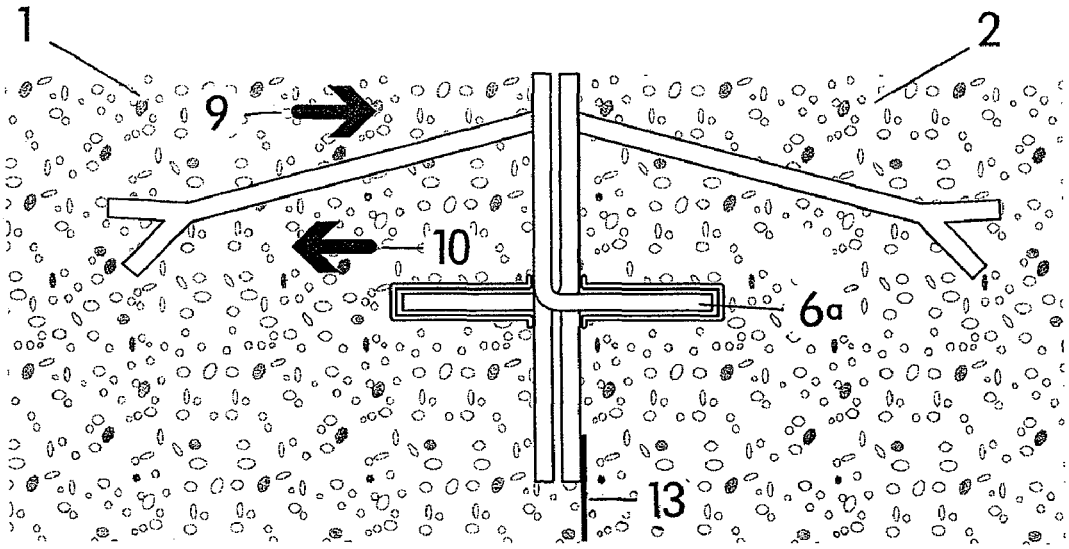
FIG. 2 illustrates the operation of the device shown in FIG. 1.

FIG. 2 explains one feature of the device. When a load is applied to the slab 2, said load is transmitted to the projection 6*a* of the profile 3, and anchored in the slab 1 by means of the dowel 5*a* lying in another plane of the slab 1. In this way, a reaction occurs in the form of a tension/compression pair 9-10 which makes it possible to balance a moment. This is therefore an embodiment capable of reducing the lift of the slab edges.

Figure 3:
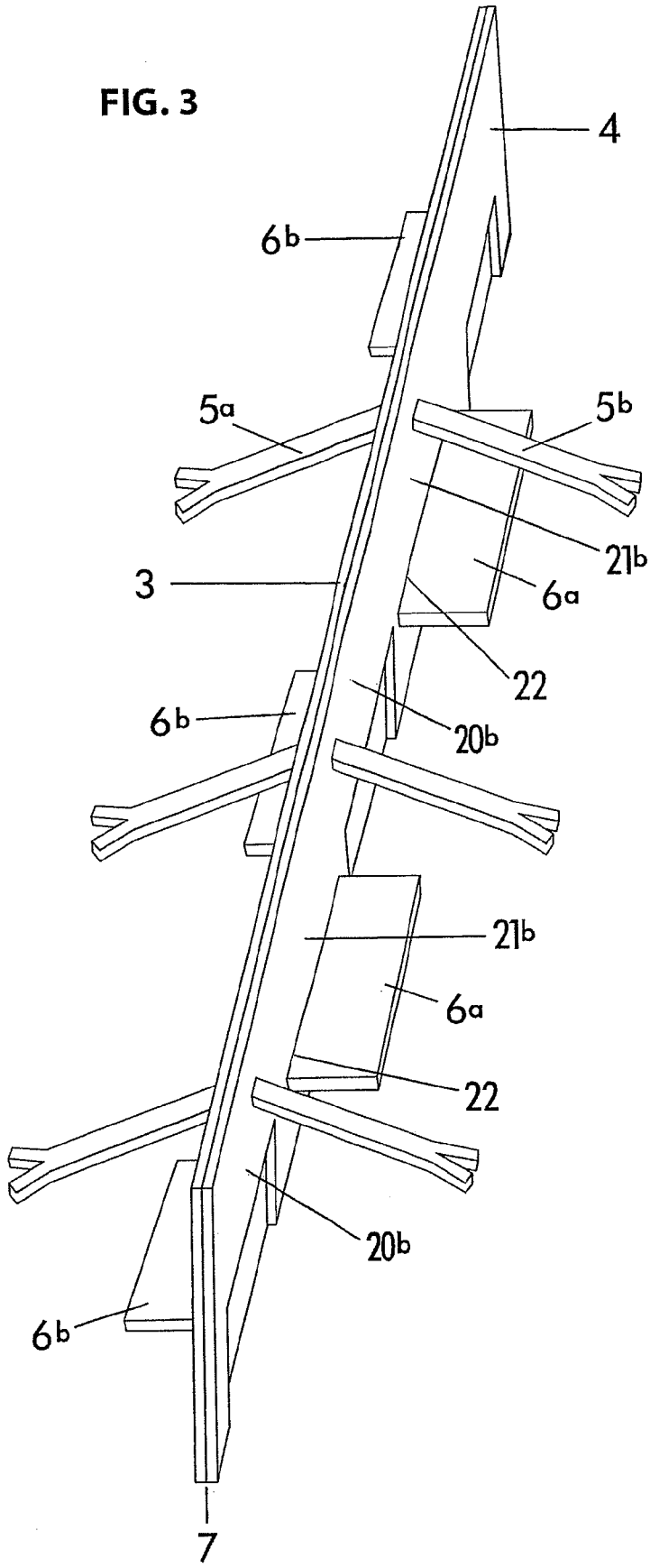
FIG. 3 represents a perspective view of the device of FIG. 1.

FIG. 3 shows the discontinuous character of the device. The bent-up projections 6*a*,6*b* integral with the profiles 3 and 4 are disposed, alternately in one slab and the other, on either side of the joint 7.

Referring once more to FIGS. 1 to 3, it is seen on these figures that each profile is constituted by a series of essentially square brackets, connected by vertical portions of the profile. A bracket of the left-hand profile 3 is formed by an upstanding portion 20*a* and by a bent-up projection 6*a* of the profile 3. A bracket of the right-hand profile 4 is formed by an upstanding portion 20*b* and a bent-up projection 6*b*. Brackets of the same profile are connected by vertical portions 21*a*, 21*b* (FIG. 3—portions of profile 4, between vertical dotted lines). Openings 22 are present in the profiles. The openings 22 of one profile 3,4 serve to let the bent-up projections of the other profile pass from one side of the joint 7 to the other side. Preferably, the device is installed in such a way that the bent-up projections 6*a*, 6*b* are situated approximately in the middle of the height of the slab. When the height of the device does not correspond to the height of the slab, a thin plate 13 is installed underneath the device, to close off the joint.

Figure 4:
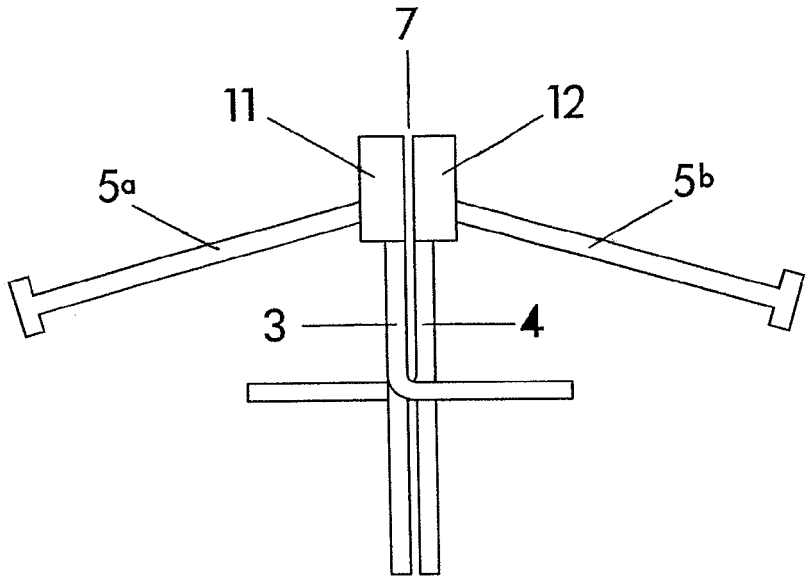
FIG. 4 represents a further modification of the device of FIG. 1.

FIG. 4 shows another arrangement according to the first embodiment of the invention. The profiles 3 and 4 are reinforced at the top by profiles 11 and 12 of larger cross section. The dowels 5*a*,5*b* may have any shape. In general, the geometry of the elements does not modify the features of the invention. Also in the embodiment of FIG. 1, the anchoring dowels 5*a*,5*b* may be anchoring elements of any suitable shape or size.

The characterizing elements of the first embodiment of the invention are the following: a device composed of two profiles which fit together, one in the other, by discontinuous bracket-shaped projections in order to ensure continuity in a slab in line with a joint while still permitting movements in the horizontal plane and protecting the slab edges, but opposing any lift and differential transverse movements.

FIGS. 5 to 8 show a device according to a second embodiment of the invention. The second embodiment of the invention is characterized by the design of the device in the sense that it is made up of a single profile, the lower part of which is bent alternately in one slab part and the other on each side of the joint. This profile is anchored by anchoring dowels in just one slab and provides protection of the concrete edge on only one side of the joint. The concrete edge on the other side of the joint is protected by a second profile, which is temporarily fixed to the first.

Figure 5:
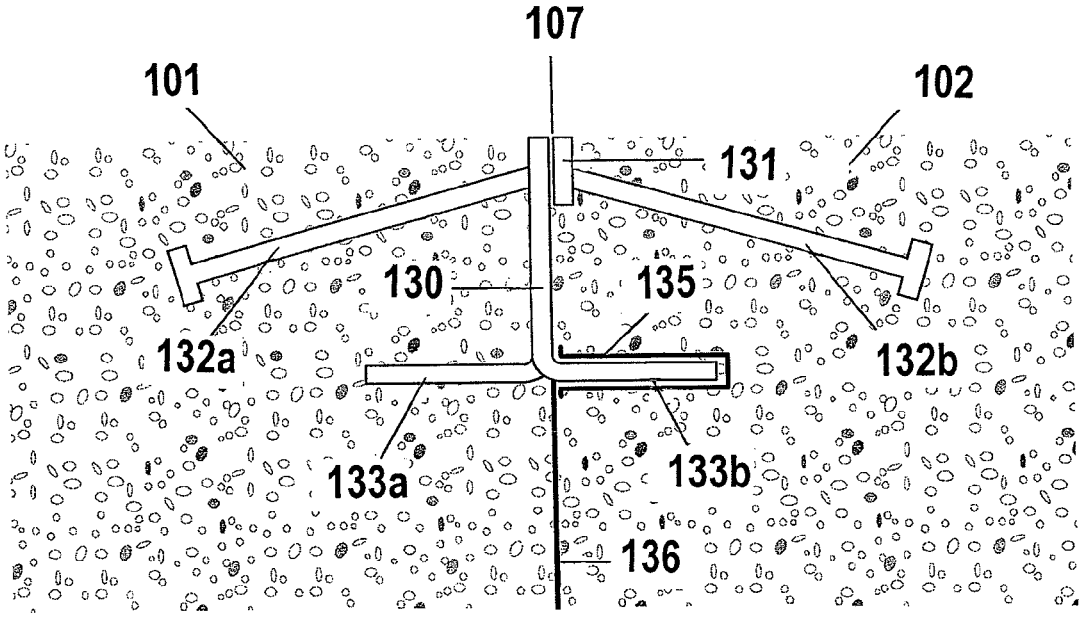
FIG. 5 represents a side view of a device according to a second embodiment of the invention.

FIG. 5 gives an example of the device according to the second embodiment of the invention. Placed in the joint separating two slabs 101 and 102 is a device composed of a profile 130 and another, smaller, profile 131, both preferably being made of metal, each placed vertically and anchored in the slab on one side of the joint 107 by means of anchoring dowels 132*a*, 132*b*. The lower part of the first profile 130 is divided into segments which are bent up alternately, to form bent-up projections 133*a*, 133*b* in the two slabs 101 and 102. A sheath 135 is placed over the projections passing through the joint 107, thereby allowing said projections to move in all directions in the plane of the slab, but independently of the latter. A thinner piece 136 is placed beneath the device in order to close off the joint. The parts 135 and 136 are not a part of the device as such. They are necessary for good operation of the device. The sheaths 135 may be attached in a temporary way to the profile, or simply placed over the projections before the device is installed.

Figure 6:
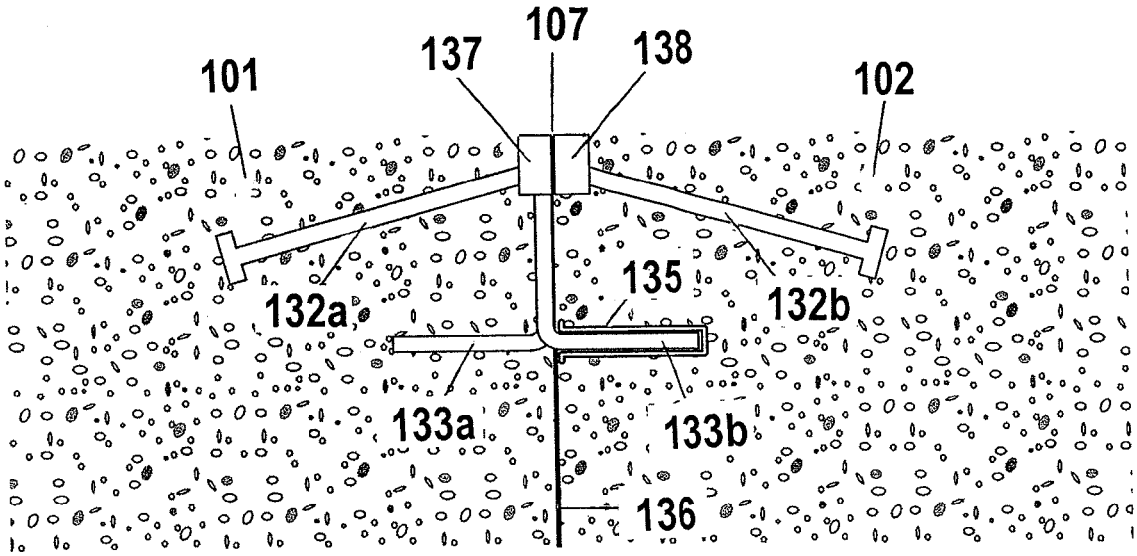
FIG. 6 represents an alternative version of the device according to the second embodiment.

FIG. 6 shows another arrangement according to the second embodiment. The profile 130 is supplemented at the top with an element 137 of different cross section. The profile 131 of FIG. 5 is then replaced with a profile 138, the upper face of which is similar to that of the profile 137. The anchoring dowels 132 may have any shape. In general, the geometry of the elements does not modify the features of the invention—the elements 137 and 138 could be replaced with angle sections or other profiles without reducing the scope of the invention. Elements 137 and 138 are not necessarily similar in size or shape.

Figure 7:
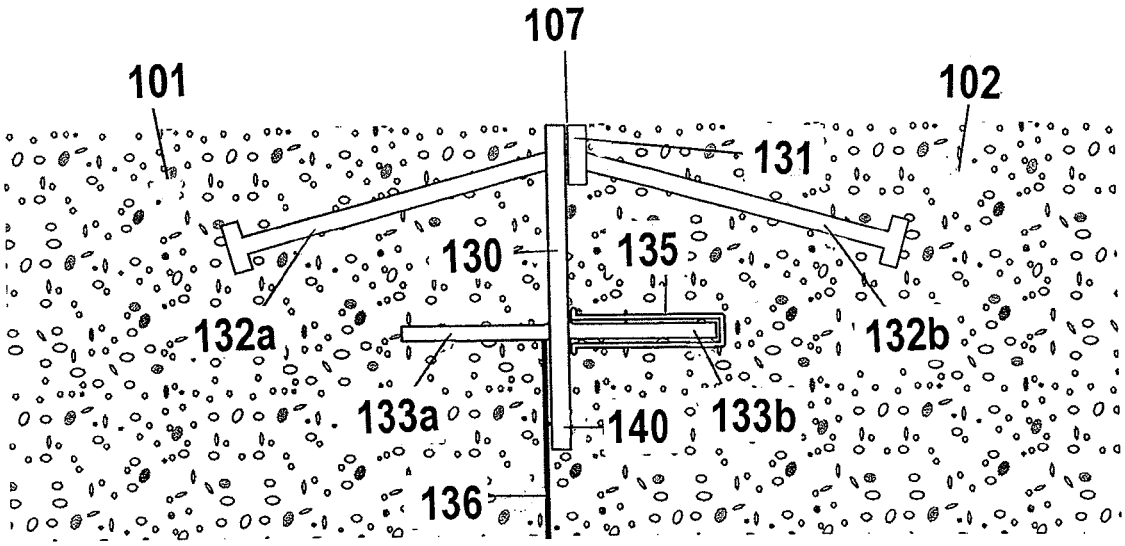
FIG. 7 represents an further alternative version of the device according to the second embodiment.

FIG. 7 shows another arrangement according to the second embodiment of the invention. The lower part of the profile 130 is divided into segments, some of which 133*a*, 133*b* are bent up to form bent-up projections alternately in the slabs 101 and 102, but others 140 are left directed downwards in order to serve as support for the thinner piece 136 that closes off the joint.

Figure 8:
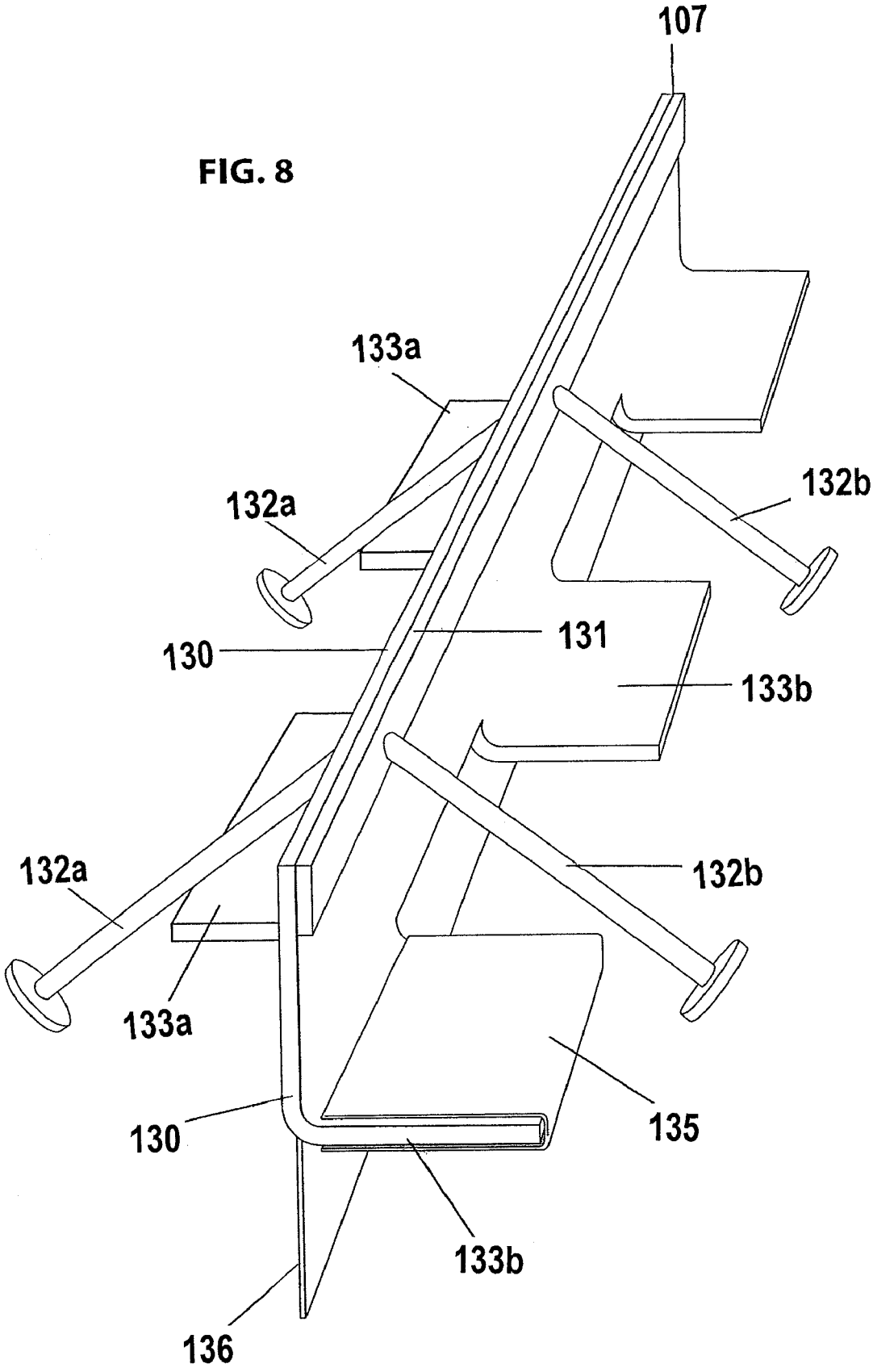
FIG. 8 represents a perspective view of the device of FIG. 5.

FIG. 8 shows the perspective view of the device according to the second embodiment, already shown in FIG. 5 and indicates the various constituent elements of the device. The drawing represents the invention with a single segment folded up alternately in one direction 133*a* and then in the other 133*b*, but this embodiment does not limit the scope—there could be several successive segments bent in the same direction, or even without a form of alternation.

As seen on FIG. 8, the device according to the second invention is built up of square bracket shaped portions, consisting of a bent-up projection 133*a* or 133*b* and an upstanding portion of the profile 130.

The characterizing elements of the second embodiment of the invention are the following: a device consisting of a profile, one part of which is bent up alternately in one direction and then in the other, to which any second profile is joined, being temporarily fastened to the first. Certain bent-up parts pass through the joint and are provided with a sheath in order to allow free movement in all directions in the plane of the slab. The two profiles are each anchored in a slab part separated by the joint. The reference to a temporary or provisional connection is explained in more detail hereafter: in the assembled device, the profile 131 or 138 is attached to the main profile 130 by a provisional attachment means such as bolts, clips or other adequate means, i.e. these profiles are not necessarily firmly attached e.g. by welding, but are fixed together with sufficiently strong attachment means to allow the device to be installed easily.

The invention claimed is:

1. A device for establishing a connection between two adjacent concrete slabs having an expansion joint between said slabs, said device comprising a first profile and a second profile, to be placed facing each other and extending in the direction of the joint, and anchoring dowels fixed to said first and second profiles, said anchoring dowels extending outward without crossing the joint, wherein parts of the first and second profiles are bent up at discrete places to form bent-up projections, arranged to pass through the joint and the second profile and the first profile, respectively; wherein each of said bent-up projections of said first and second profiles, together with an upstanding portion of the first and second profiles, respectively, forms a substantially square bracket and wherein the upstanding portions of the first and second profiles are connected by vertical portions of said first profile and said second profile, respectively, said vertical portions including openings through which the bent-up projections of respectively, the second profile and the first profile pass.

2. The device according to claim 1, comprising at the top of said profiles, additional reinforcement profiles of larger cross section than said first and second profile.

3. The device according to claim 1, wherein said profiles are metal profiles.

4. The device according to claim 1, further comprising sheaths placed over the bent-up projections.

* * * * *